US009931878B2

(12) United States Patent
Steenackers et al.

(10) Patent No.: US 9,931,878 B2
(45) Date of Patent: Apr. 3, 2018

(54) COLOUR LASER MARKABLE LAMINATES AND DOCUMENTS

(71) Applicant: AGFA GEVAERT, Mortsel (BE)

(72) Inventors: Marin Steenackers, Mortsel (BE); Johan Loccufier, Mortsel (BE); Bart Aerts, Mortsel (BE); Anouschka Depla, Mortsel (BE)

(73) Assignee: AGFA-GEVAERT, Mortsel (BE)

( * ) Notice: Subject to any disclaimer, the term of this patent is extended or adjusted under 35 U.S.C. 154(b) by 0 days.

(21) Appl. No.: 15/105,649

(22) PCT Filed: Dec. 18, 2014

(86) PCT No.: PCT/EP2014/078442
§ 371 (c)(1),
(2) Date: Jun. 17, 2016

(87) PCT Pub. No.: WO2015/091782
PCT Pub. Date: Jun. 25, 2015

(65) Prior Publication Data

US 2016/0318327 A1 Nov. 3, 2016

(30) Foreign Application Priority Data

Dec. 19, 2013 (EP) ..... 13198470

(51) Int. Cl.
*B41M 3/14* (2006.01)
*B41M 5/337* (2006.01)
(Continued)

(52) U.S. Cl.
CPC ..... *B41M 5/3375* (2013.01); *B41M 3/142* (2013.01); *B41M 5/267* (2013.01); *B41M 5/327* (2013.01); *B41M 5/3275* (2013.01); *B41M 5/3333* (2013.01); *B41M 5/423* (2013.01); *B41M 5/465* (2013.01); *B42D 25/41* (2014.10); *B42D 25/45* (2014.10); *B41M 5/34* (2013.01); *B41M 2205/04* (2013.01);
(Continued)

(58) Field of Classification Search
CPC ..... B41M 3/14; B41M 3/142; B41M 5/26; B41M 5/262; B41M 5/267; B41M 5/333; B41M 5/3333; B41M 5/3335; B41M 5/3336; B41M 5/337; B41M 5/3372; B41M 5/3375; B41M 5/46; B41M 5/465; B41M 2205/04; B41M 5/323; B41M 5/3337
USPC ..... 503/201, 216
See application file for complete search history.

(56) References Cited

U.S. PATENT DOCUMENTS 5,858,583 A 1/1999 Dessauer et al.

FOREIGN PATENT DOCUMENTS

EP 0 941 866 A1 9/1999
EP 2 181 858 A1 5/2010
(Continued)

OTHER PUBLICATIONS

Official Communication issued in International Patent Application No. PCT/EP2014/078442, dated Apr. 8, 2015.

*Primary Examiner* — Bruce H Hess
(74) *Attorney, Agent, or Firm* — Keating and Bennett, LLP

(57) ABSTRACT

A colour laser markable laminate includes a colour laser markable layer including a leuco dye and an infrared absorbing compound, an optional adhesive layer, a polymeric support, an optional outerlayer, wherein the colour laser markable layer further includes an acid scavenger. The support, the optional adhesive layer, or the optional outer layer includes a UV absorbing compound.

13 Claims, 2 Drawing Sheets

(51) Int. Cl.

| | |
|---|---|
| ***B41M 5/46*** | (2006.01) |
| ***B41M 5/26*** | (2006.01) |
| ***B41M 5/327*** | (2006.01) |
| ***B41M 5/42*** | (2006.01) |
| ***B42D 25/41*** | (2014.01) |
| ***B42D 25/45*** | (2014.01) |
| ***B41M 5/333*** | (2006.01) |
| *B41M 5/34* | (2006.01) |

(52) U.S. Cl.
CPC ..... *B41M 2205/36* (2013.01); *B41M 2205/38* (2013.01); *B41M 2205/42* (2013.01)

(56) References Cited

FOREIGN PATENT DOCUMENTS

| | | | |
|---|---|---|---|
| EP | 2 329 956 | A1 | 6/2011 |
| EP | 2 463 110 | A1 | 6/2012 |
| EP | 2 474 963 | A1 | 7/2012 |
| EP | 2 490 157 | A2 | 8/2012 |
| EP | 2 500 178 | A2 | 9/2012 |
| EP | 2 567 825 | A1 | 3/2013 |
| EP | 2 639 074 | A1 | 9/2013 |
| JP | 06-328843 | A | 11/1994 |
| WO | 2007/063339 | A2 | 6/2007 |
| WO | 2008/122504 | A1 | 10/2008 |

COLOUR LASER MARKABLE LAMINATES AND DOCUMENTS

CROSS-REFERENCE TO RELATED APPLICATIONS

This application is a 371 National Stage Application of PCT/EP2014/078442, filed Dec. 18, 2014. This application claims the benefit of European Application No. 13198470.0, filed Dec. 19, 2013, which is incorporated by reference herein in its entirety.

BACKGROUND OF THE INVENTION

1. Field of the Invention

This invention relates to laser markable laminates and documents, especially security documents.

2. Description of the Related Art

Security cards are widely used for various applications such as identification purposes (ID cards) and financial transfers (credit cards). Such cards typically consist of a laminated structure consisting of various papers or plastic laminates and layers wherein some of them may carry alphanumeric data and a picture of the card holder. So called 'smart cards' can also store digital information by including an electronic chip in the card body. A principal objective of such articles and security cards is that they cannot be easily modified or reproduced in such a way that the modification or reproduction is difficult to distinguish from the original.

Two techniques frequently used for preparing security documents are laser marking and laser engraving. In literature, laser engraving is often incorrectly used for laser marking. In laser marking, a colour change is observed by local heating of material, while in laser engraving material is removed by laser ablation.

Well known in the field of laser markable security documents is the use of laser markable polymeric supports. Laser marking produces a colour change from white to black in a laser markable support through carbonization of the polymer, usually polycarbonate as disclosed in e.g. EP-A 2181858 (AGFA GEVAERT).

During the past last years, there is an increased interest of using laser markable layers. The advantage of using a laser markable layer coated on a support instead of a laser markable support, is that a support can be used which has better physical properties than the laser markable supports, such as for example a higher flexibility than a polycarbonate support as disclosed in e.g. EP-A 2567825 (AGFA GEVAERT).

Laser markable layers typically contain colour forming compounds (also called "leuco-dyes") which can change from essentially colourless or pale-coloured to coloured when irradiated with UV light, IR light and/or heated. Different classes of leuco dyes are well known and widely used in conventional pressure-sensitive, photosensitive or thermally-sensitive recording materials ("Chemistry and Applications of Leuco Dyes", Ramaiah Muthyala, Plenum Press, 1997).

A disadvantage of a material, for example a colour laser markable laminate including such a colour laser markable layer, may be their limited daylight stability. For that reason, so-called daylight stabilizers may be added to the colour laser markable layer.

Daylight stabilizers can be classified in 5 classes: UV-absorbers (such as for example hydroxybenzophenones, triarylimidazoles, 2-hydroxyphenyl-s-triazines and hydroyphenyl-benzotriazoles), quenchers (such as for example nickel phenolates), hydroxyperoxide decomposers (such as for example dialkyldithiocarbamates, dialkyldithiophosphates and thiobisphenolates), antioxidants (such as for example phenolic antioxidants, phosphites, phosphonites and sulfur compounds) and hindered amine light stabilizers (HALS). More information on daylight stabilizers can be found in "Plastics Additives Handbook, 5$^{th}$ Edition", Hans Zweifel, HANSER, 2001).

EP0941866 discloses a thermally imageable element having an improved light stability comprising a leuco-dye, optionally an IR-absorbing dye and optionally an UV-absorber such as polyhydroxybenzophenones, triarylimidazoles or hydroyphenylbenzotriazoles.

JP06328843 (FUJI) discloses a laser imageable recording material with leuco-dyes and an UV-absorber for improved lightfastness.

WO2008122504 (CIBA) describes the use of leuco-dyes in combination with UV-absorbers and/or HALS for an improved light stability.

EP2639074 (AGFA) discloses a colour laser markable laminate including at least a transparent polymeric support and a colour forming layer comprising a leuco-dye; an infrared dye; and a polymeric binder comprising vinyl acetate and at least 85 wt % of vinyl chloride based on the total weight of the binder; wherein the colour laser markable laminate includes a specific phenol stabilizer sterically hindered by a ring containing three nitrogen atoms.

However, the addition of daylight stabilizers may negatively impact the performance of the laminate, such as giving significantly less colour formation upon laser marking (loss of sensitivity). Such a lower sensitivity requires longer exposure time of the laser.

For laser markable layers, the use of acid-sensitive leuco-dyes is preferred since it includes both advantages of the blister formation security feature and the enhanced shelf-life stability, such as disclosed in e.g. EP-A 2463110 (AGFA). However, acid-sensitive leuco-dyes for laser markable layers are typically used in combination with acid-generating compounds such as photoacid-generators (PAG). The use of such acid-generating compounds has the disadvantage that they may not be daylight stable.

WO2007063339 (DATALASE) discloses a laser markable composition comprising a dye responsive to the presence of hydrogen ions, a compound that generates an acid on irradiation and optionally an anti-oxidant to improve the daylight stability.

U.S. Pat. No. 5,858,583 (DUPONT) discloses a thermally imageable element comprising a HABI compound, a leuco dye, an acid-generating compound and a near IR absorbing dye. The daylight stability can be improved by the addition of UV absorbers and/or antioxidants.

A further requirement of colour laser markable laminates for security cards is an excellent thermal stability. Lamination is usually performed at elevated temperatures in order to achieve a good adhesion between the different layers. Laser markable layers comprising leuco-dyes and acid generators may have a limited thermal stability which results in background stain of the laser markable material after lamination at elevated temperatures.

SUMMARY OF THE INVENTION

It is an object of the invention to provide a laser markable laminate having a high sensitivity and an improved daylight and thermal stability. This object is realized by a laser markable laminate as defined below.

It has been surprisingly found that a laser markable laminate including a laser markable layer comprising a leuco dye and an infrared absorbing compound could be improved for daylight and thermal stability while maintaining a high sensitivity by using an acid scavenger in the colour laser markable layer and an UV absorber in a neighbouring layer or support.

Further advantages and preferred embodiments of the present invention will become apparent from the following description.

BRIEF DESCRIPTION OF THE DRAWINGS

In the drawings FIGS. 1 to 3 the following numbering is adhered to:

13, 23, and 33=transparent polymeric support, e.g. PET-C;

11, 21, and 31=colour forming layer;

14, 24 and 34=outer layer;

25 and 35=opaque white core support, e.g. white PETG; and

12, 22 and 32=an adhesive layer.

Figure 1:
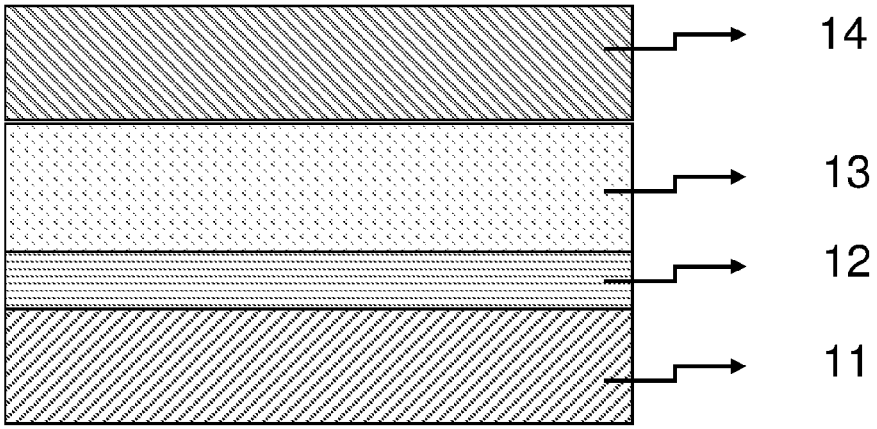

FIG. 1 shows a cross section of a preferred embodiment of a colour laser markable laminate according to the present invention.

Figure 2:
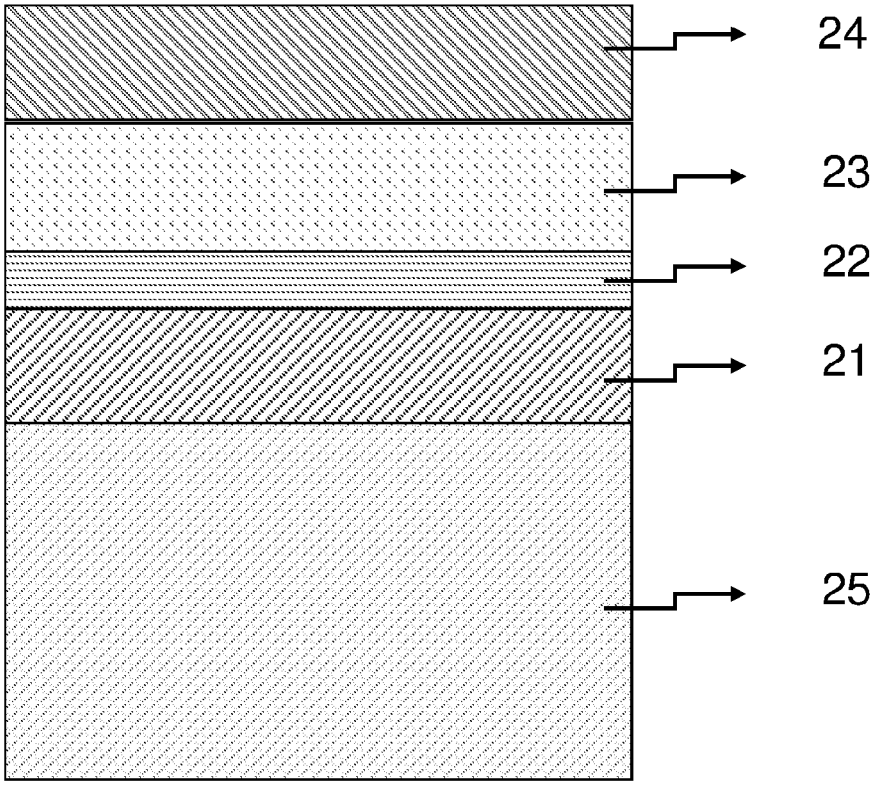

FIG. 2 shows a cross section of a preferred embodiment of a colour laser markable document according to the present invention including on one side a colour laser markable laminate according to FIG. 1.

Figure 3:
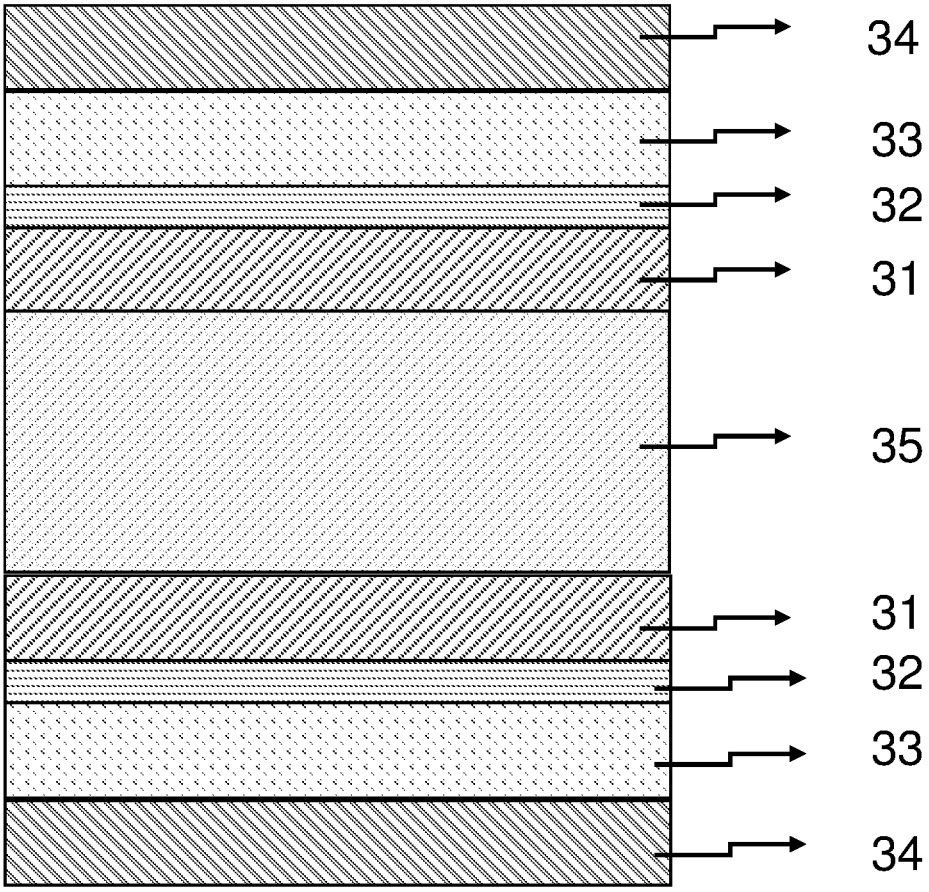

FIG. 3 shows a cross section of another preferred embodiment of a colour laser markable document according to the present invention including on both sides a colour laser markable laminate according to FIG. 1.

DETAILED DESCRIPTION OF THE PREFERRED EMBODIMENTS

The terms "polymeric support" and "foil", as used herein, mean a self-supporting polymer-based sheet, which may be associated with one or more adhesion layers e.g. subbing layers. Supports and foils are usually manufactured through extrusion.

The term "layer", as used herein, is considered not to be self-supporting and is manufactured by coating it on a (polymeric) support or foil.

The term "leuco-dye" as used herein refers to compounds which change from essentially colourless to coloured when heated, with or without the presence of other reagents.

"PET" is an abbreviation for polyethylene terephthalate.

"PETG" is an abbreviation for polyethylene terephthalate glycol, the glycol indicating glycol modifiers which are incorporated to minimize brittleness and premature aging that occur if unmodified amorphous polyethylene terephthalate (APET) would be used in the production of cards.

"PET-C" is an abbreviation for crystalline PET, i.e. a biaxially stretched polyethylene terephthalate. Such a polyethylene terephthalate support has excellent properties of dimensional stability.

The definitions of security features correspond with the normal definition as adhered to in the "Glossary of Security Documents—Security features and other related technical terms" as published by the Consilium of the Council of the European Union on Aug. 25, 2008 (Version: v.10329.02.b.en) on its website: http://www.consilium.europa.eu/prado/EN/glossaryPopup.html.

The term "alkyl" means all variants possible for each number of carbon atoms in the alkyl group i.e. methyl, ethyl, for three carbon atoms: n-propyl and isopropyl; for four carbon atoms: n-butyl, isobutyl and tertiary-butyl; for five carbon atoms: n-pentyl, 1,1-dimethyl-propyl, 2,2-dimethyl-propyl and 2-methyl-butyl etc.

The term "alkoxy" means all variants possible for each number of carbon atoms in the alkyl group i.e. methoxy, ethoxy, for three carbon atoms: n-propoxy and isopropoxy; for four carbon atoms: n-butoxy, isobutoxy and tertiary-butoxy etc.

Colour Laser Markable Laminates and Documents

The colour laser markable laminate according to the present invention comprises:

- a colour laser markable layer (11) comprising a leuco dye and an infrared absorbing compound;
- an optional adhesive layer (12);
- a support (13); and
- an optional outerlayer (14);

characterized in that the colour laser markable layer further comprises an acid scavenger and that the support, the optional adhesive layer or the optional outer layer comprises an UV absorbing compound.

The support of the colour laser markable laminate is preferably a transparent polymeric support.

In a preferred embodiment the colour laser markable laminate comprises in this order:

- a colour laser markable layer (11) comprising a leuco dye and an infrared absorbing compound;
- an optional adhesive layer (12);
- a support (13); and
- an optional outerlayer (14);

characterized in that the colour laser markable layer further comprises an acid scavenger and that the support, the optional adhesive layer or the optional outer layer comprises an UV absorbing compound.

In another preferred embodiment of the invention, a colour laser markable self-supporting material, for example a sheet, comprising a leuco dye, an infrared absorbing compound and an acid scavenger may be used instead of a colour laser markable layer provided on a support. The colour laser markable laminate according to such a preferred embodiment comprises:

- a colour laser markable self-supporting material containing a leuco dye, an infrared absorbing compound and an acid scavenger; and
- an outer layer containing an UV absorbing compound.

One or two colour laser markable laminates may be used to prepare a laser markable document including a core support. The core support may be transparent but is preferably an opaque white core support.

In one preferred embodiment of the colour laser markable document, the colour forming layer is located between the opaque white core support and the transparent polymeric support of a colour laser markable laminate.

In another preferred embodiment of the colour laser markable document, a second colour laser markable laminate is used in the document on the other side of the opaque white core support, wherein the colour forming layer of the second laminate is located between the opaque white core support and the transparent polymeric support of the second laminate.

The colour laser markable document may contain on the same side of the opaque white core support as the colour forming layer at least one second colour forming layer capable of forming a different colour.

The colour laser markable document according to the present invention contains at least one colour forming layer, but preferably contains two, three or more colour forming layers on the same side of the opaque white core support for producing a multi-coloured document.

The colour laser markable document according to the present invention preferably contains at least three colour forming layers on at least the one side of the opaque white core support wherein the at least three colour forming layers include different infrared absorbing compounds and also different leuco dyes.

The infrared absorbing compound is preferably an infrared dye. An infrared dye not only delivers the heat for the colour forming action, but also has the advantage that there is no or minimal absorption in the visible spectrum and thus there is no or minimal interference with the colours formed by the one or more colour forming layers. This also allows having, for example, a pure white background in a security document.

In a preferred embodiment the colour forming layer is capable of forming a cyan or blue colour image on laser marking. The article preferably contains two other colour forming layers for forming a magenta respectively a yellow image or for forming a red respectively a green image, since most colour management systems for producing colour images are based on either a CMY or RGB colour reproduction.

The colour laser markable document is preferably a security document precursor, more preferably including an electronic chip.

In a preferred embodiment, the colour laser marked document is a security document, preferably selected from the group consisting of a passport, a personal identification card and a product identification document.

The colour laser markable document preferably also contains electronic circuitry, more preferably the electronic circuitry includes a RFID chip with an antenna and/or a contact chip. The security document is preferably a "smart card", meaning an identification card incorporating an integrated circuit. In a preferred embodiment the smart card includes a radio frequency identification or RFID-chip with an antenna. Inclusion of electronic circuitry makes forgery more difficult.

The colour laser markable document preferably has a format as specified by ISO 7810. ISO 7810 specifies three formats for identity cards: ID-1 with the dimensions 85.60 mm×53.98 mm, a thickness of 0.76 mm is specified in ISO 7813, as used for bank cards, credit cards, driving licences and smart cards; ID-2 with the dimensions 105 mm×74 mm, as used in German identity cards, with typically a thickness of 0.76 mm; and ID-3 with the dimensions 125 mm×88 mm, as used for passports and visa's. When the security cards include one or more contactless integrated circuits then a larger thickness is tolerated, e.g. 3 mm according to ISO 14443-1.

In another preferred embodiment, the colour laser markable document is a product identification document which is usually attached to the packaging material of the product or to the product itself. The product identification document not only allows to verify the authenticity of the product, but also to maintain the attractive look of a product (packaging).

Colour Forming Layers

The colour forming layer(s) can be provided onto a support by co-extrusion or any conventional coating technique, such as dip coating, knife coating, extrusion coating, spin coating, spray coating, slide hopper coating and curtain coating. Preferably the colour forming layer is coated with a slide hopper coater or a curtain coater, more preferably coated onto a transparent polymeric support including a subbing layer.

The dry thickness of the colour forming layer is preferably between 1 and 50 g/m$^2$, more preferably between 2 and 25 g/m$^2$, and most preferably between 3 and 15 g/m$^2$.

UV Absorbers

Examples of suitable UV-absorbers include 2-hydroxyphenyl-benzophenones (BP) such as Chimassorb™ 81 and Chimassorb™ 90 from BASF; 2-(2-hydroxyphenyl)-benzotriazoles (BTZ) such as Tinuvin™ 109, Tinuvin™ 1130, Tinuvin™ 171, Tinuvin™ 326, Tinuvin™ 328, Tinuvin™ 384-2, Tinuvin™ 99-2, Tinuvin™ 900, Tinuvin™ 928, Tinuvin™ Carboprotect™, Tinuvin™ 360, Tinuvin™ 1130, Tinuvin™ 327, Tinuvin™ 350, Tinuvin™ 234 from BASF, Mixxim™ BB/100 from FAIRMOUNT, Chiguard 5530 from Chitec; 2-hydroxy-phenyl-s-triazines (HPT) such as Tinuvin™ 460, Tinuvin™ 400, Tinuvin™ 405, Tinuvin™ 477, Tinuvin™ 479, Tinuvin™ 1577 ED, Tinuvin™ 1600 from BASF, 2-(2,4-dihydroxyphenyl)-4,6-bis-(2,4-dimethylphenyl)-s-triazine (CASRN1668-53-7) from Capot Chemical Ltd and 4-[4,6-bis(2-methyl-phenoxy)-1,3,5-triazin-2-yl]-1,3-benzenediol (CASRN13413-61-1); titanium dioxide such as Solasorb 100F from from Croda Chemicals; zink oxide such as Solasorb 200F from Croda Chemicals; benzoxazines such as Cyasorb UV-3638 F, CYASORB™ UV-1164 from CYTEC; and oxamides such as Sanduvor VSU from Clariant.

Preferred UV absorbers have in the wavelength region between 300 and 400 nm a maximum absorption above 330 nm, more preferably above 350 nm.

Particular preferred UV absorbers are hydroxyphenyl benzotriazoles and 2-hydroxyphenyl-s-triazines having a maximum absorption above 350 nm in the wavelength region 300-400 nm.

The UV-absorber may be present in a laser markable layer or may also be present in another layer, for example, an outer layer. In a preferred embodiment, the UV-absorber is present in an outer layer.

Acid Scavenger

The colour forming layer of the security laminate contains one or more acid scavengers.

Acid scavengers include organic or inorganic bases. Examples of the inorganic bases include hydroxides of alkali metals or alkaline earth metals; secondary or tertiary phosphates, borates, carbonates; quinolinates and metaborates of alkali metals or alkaline earth metals; a combination of zinc hydroxide or zinc oxide and a chelating agent (e.g., sodium picolinate); hydrotalcite such as Hycite 713 from Clariant; ammonium hydroxide; hydroxides of quaternary alkylammoniums; and hydroxides of other metals. Examples of the organic bases include aliphatic amines (e.g., trialkylamines, hydroxylamines and aliphatic polyamines); aromatic amines (e.g., N-alkyl-substituted aromatic amines, N-hydroxylalkyl-substituted aromatic amines and bis[p-(dialkylamino) phenyl]-methanes), heterocyclic amines, amidines, cyclic amidines, guanidines and cyclic guanidines.

Other preferred acid scavangers are HALS compounds. Example of suitable HALS include Tinuvin™ 292, Tinuvin™ 123, Tinuvin™ 1198, Tinuvin™ 1198 L, Tinuvin™ 144, Tinuvin™ 152, Tinuvin™ 292, Tinuvin™ 292 HP, Tinuvin™ 5100, Tinuvin™ 622 SF, Tinuvin™ 770 DF, Chimassorb™ 2020 FDL, Chimassorb™ 944 LD from BASF; Hostavin 3051, Hostavin 3050, Hostavin N 30, Hostavin N321, Hostavin N 845 PP, Hostavin PR 31 from Clariant.

Further examples of acid scavengers are salts of weak organic acids such as carboxilates (e.g. calcium stearate).

A preferred acid scavanger is an organic base, more preferably an amine.

A particular preferred acid scavenger is an organic base having a pKb of less than 7.

Leuco Dyes

The term "leuco dye" as used herein refers to compounds which can change from essentially colourless or pale-coloured to coloured when irradiated with UV light, IR light and/or heated. All publicly-known leuco dyes can be used and are not restricted. They are for example widely used in conventional pressure-sensitive, photosensitive or thermally-sensitive recording materials. For more information about leuco dyes, see for example "Chemistry and Applications of Leuco Dyes", Ramaiah Muthyala, Plenum Press, 1997.

A number of classes of leuco dyes may be used as colour forming compounds in the present invention, such as for example: spiropyran leuco dyes such as spirobenzopyrans (e.g. spiroindolinobenzopyrans, spirobenzopyranobenzopyrans, 2,2-dialkylchromenes), spironaphtooxazine and spirothiopyran; leuco quinone dyes; azines such as oxazines, diazines, thiazines and phenazine; phthalide- and phthalimidine-type leuco dyes such as triarylmethane phtalides (e.g. crystal violet lactone), diarylmethane phthalides, monoarylmethane phthalides, heterocyclic substituted phthalides, alkenyl substituted phthalides, bridged phthalides (e.g. spirofluorene phthalides and spirobenzanthracene phthalides) and bisphthalides; fluoran leuco dyes such as fluoresceins, rhodamines and rhodols; triarylmethanes such as leuco crystal violet; ketazines; barbituric acid leuco dyes and thiobarbituric acid leuco dyes.

In the present invention, leuco dyes can optionally be combined with a photosensitizing dye and/or a photoacid generator.

The colour forming compound is preferably present in the colour forming layer in an amount of 0.05 to 5.0 g/m$^2$, more preferably in an amount of 0.1 to 3.0 g/m$^2$, most preferably in an amount of 0.2 to 1.0 g/m$^2$.

The following reaction mechanisms and leuco dyes are suitable to form a coloured dye.

1. Protonation of a Leuco Dye After Fragmentation of an Acid Generator

The reaction mechanism can be represented by:

Leuco-dye+acid generator→Leuco-dye+acid→Coloured Dye

All publicly-known photo- and thermal acid generators can be used for the present invention. They can optionally be combined with a photosensitizing dye. Photo- and thermal acid generators are for example widely used in conventional photoresist material. For more information see for example "Encyclopaedia of polymer science", 4$^{th}$ edition, Wiley or "Industrial Photoinitiators, A Technical Guide", CRC Press 2010.

Preferred classes of photo- and thermal acid generators are iodonium salts, sulfonium salts, ferrocenium salts, sulfonyl oximes, halomethyl triazines, halomethylarylsulfone, α-haloacetophenones, sulfonate esters, t-butyl esters, allyl substituted phenols, t-butyl carbonates, sulfate esters, phosphate esters and phosphonate esters.

Preferred Leuco Dyes are phthalide- and phthalimidine-type leco dyes such as triarylmethane phtalides, diarylmethane phthalides, monoarylmethane phthalides, heterocyclic substituted phthalides, alkenyl substituted phthalides, bridged phthalides (e.g. spirofluorene phthalides and spirobenzanthracene phthalides) and bisphthalides; and fluoran Leuco Dyes such as fluoresceins, rhodamines and rhodols.

In a more preferred embodiment of the present invention, a combination is used of at least one compound selected from the group consisting of CASRN 50292-95-0, CASRN 89331-94-2, CASRN1552-42-7 (crystal violet lactone), CASRN148716-90-9, CASRN 630-88-6, CASRN 36889-76-7 or CASRN 132467-74-4 as the Leuco Dye and at least one compound selected from the group consisting of CASRN 58109-40-3, CASRN 300374-81-6, CASRN 1224635-68-0, CASRN 949-42-8, CASRN 69432-40-2, CASRN 3584-23-4, CASRN 74227-35-3, CASRN 953-91-3 or CASRN6542-67-2 as acid generator.

2. Oxidation of a Triarylmethane Leuco Dye

The reaction mechanism can be represented by:

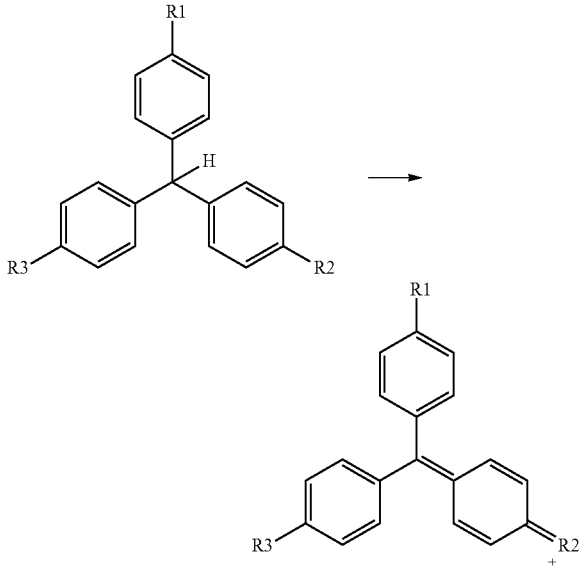

wherein R1, R2 and R3 each independently represent an amino group, an optionally substituted mono- or dialkylamino group, a hydroxyl group or an alkoxy group. R1 and R3 also each independently represent a hydrogen atom or an optionally substituted alkylene, arylene, or heteroarylene. A preferred leuco dye for the present invention is leuco crystal violet (CASRN 603-48-5).

3. Oxidation of a Leuco Quinone Dye

The reaction mechanism can be represented by

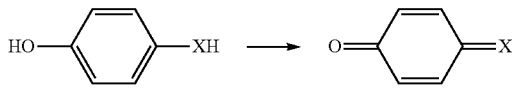

wherein X represents an oxygen atom or an optionally substituted amino or methine group.

4. Fragmentation of a Leuco Dye

The reaction mechanism can be represented by:

Leuco Dye-FG→Dye wherein FG represents a fragmenting group.

Preferred leuco dyes are oxazines, diazines, thiazines and phenazine. A particularly preferred leuco dye (CASRN104434-37-9) is shown in EP 174054 (POLAROID) which discloses a thermal imaging method for forming colour images by the irreversible unimolecular fragmentation of one or more thermally unstable carbamate moieties of an organic compound to give a visually discernible colour shift from colourless to coloured.

The fragmentation of a leuco dye may be catalyzed or amplified by acids, photo acid generators, and thermal acid generators.

5. Ring Opening of Spiropyran Leuco Dyes

The reaction mechanism can be represented by:

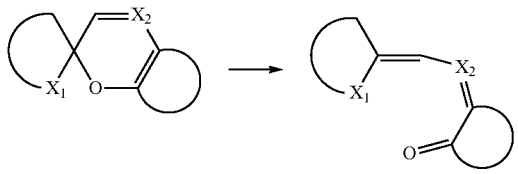

wherein $X_1$ represents an oxygen atom, an amino group, a sulphur atom or a selenium atom and $X_2$ represents an optionally substituted methine group or a nitrogen atom.

The preferred spiropyran leuco dyes for the present invention are spiro-benzopyrans such as spiroindolinobenzopyrans, spirobenzopyranobenzopyrans, 2,2-dialkylchromenes; spironaphtooxazines and spirothiopyrans. In a particularly preferred embodiment, the spiropyran leuco dyes are CASRN 160451-52-5 or CASRN 393803-36-6. The ring opening of a spiropyran leuco dye may be catalyzed or amplified by acids, photo acid generators, and thermal acid generators.

In a preferred embodiment of a laser markable layer for producing a cyan colour, the cyan colour forming compound has a structure according to Formulae CCFC1, CCFC2 or CCFC3.

CCFC1

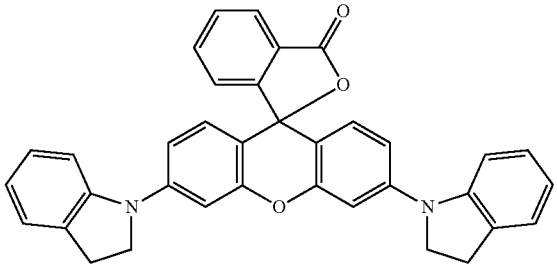

CCFC2

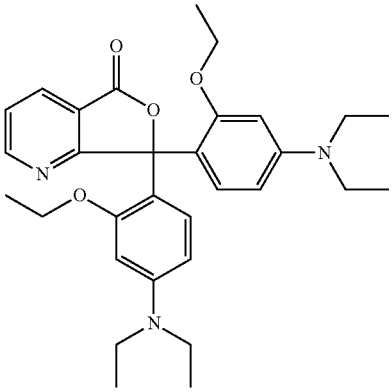

-continued

CCFC3

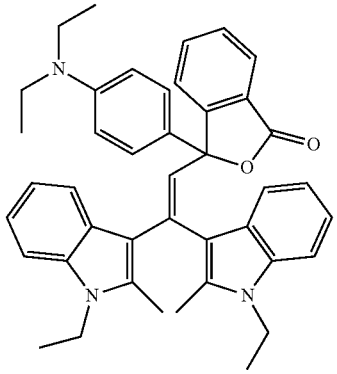

In a preferred embodiment of a laser markable layer for producing a magenta colour, the magenta colour forming compound has a structure according to Formula MCFC2:

MCFC2

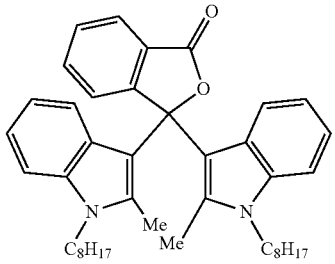

In a preferred embodiment of a laser markable layer for producing a red colour, the red colour forming compound has a structure according to Formula RCFC:

RCFC

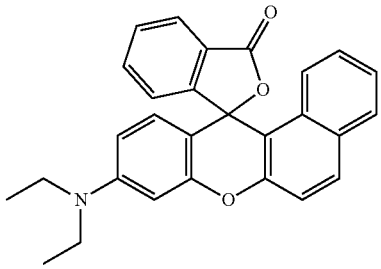

In a preferred embodiment of a laser markable layer for producing a yellow colour, the yellow colour forming compound has a structure according to Formula YCFC:

YCFC

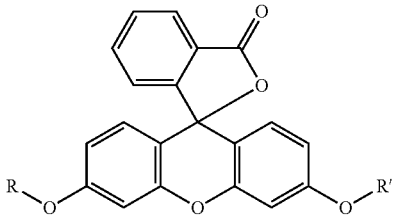

wherein R, R' are independently selected from a group consisting of a linear alkyl group, a branched alkyl group, an aryl and aralkyl group.

In one preferred embodiment, the yellow colour forming compound has a structure according to Formula YCFC, wherein R and R' independently represent a linear alkyl group, a branched alkyl group, an aryl or an aralkyl group substituted by at least one functional group containing an oxygen atom, a sulphur atom or a nitrogen atom.

A particularly preferred yellow colour forming compound is the compound according to Formula YCFC wherein both R and R' are methyl.

In a most preferred embodiment of a laser markable layer for producing a yellow colour, the yellow colour forming compound has a structure according to Formulae YCFC1 or YCFC2

YCFC1

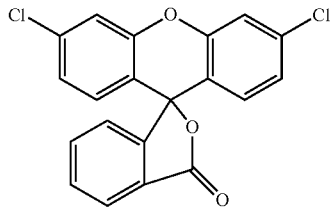

YCFC2

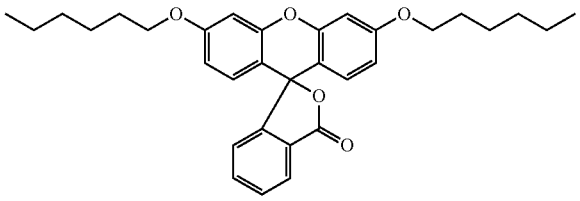

In a preferred In a preferred embodiment of a laser markable layer for producing a black colour, the black colour forming compound has a structure according to Formula BCFC

BCFC

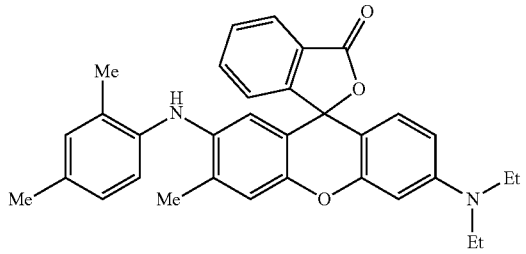

Wherein Me is Methyl and Et is Ethyl.

Infrared Absorbing Compounds

The colour forming layer contains one or more infrared absorbers for the conversion of electromagnetic radiation into heat when the layer is laser marked by an infrared laser. Infrared absorbers may be organic or inorganic, dyes or pigments.

When multicoloured articles are desired, then the security element includes a plurality of colourless colour forming layers containing different infrared dyes and colour forming compounds. The infrared dyes differ in wavelength of maximum absorption $\lambda_{max}$ so that they can be addressed by different infrared lasers with corresponding emission wavelengths causing colour formation only in the colour forming layer of the addressed infrared dye.

Suitable examples of infrared absorbers include, but are not limited to, quinone-diimmonium salts, aminium salts, polymethyl indoliums, metal complex IR absorbers, indocyanine green, polymethines, croconiums, cyanines, merocyanines, squaryliums, chalcogenopyryloarylidenes, metal thiolate complexes, bis(chalcogenopyrylo)polymethines, oxyindolizines, bis(aminoaryl)polymethines, indolizines, pyryliums, quinoids, quinones, phthalocyanines, naphthalocyanines, azo absorbers, (metalized) azomethines, carbon black such as acetylene black, channel black and furnace black, alkylated triphenyl phosphorothionates; oxides, hydroxides, sulfides, sulfates and phosphates of metals such as copper, bismuth, iron, nickel, tin, zinc, manganese, zirconium, tungsten, lanthanum, and antimony including lanthane hexaboride, indium tin oxide (ITO) and antimony tin oxide, titanium black and black iron oxide.

The infrared absorbing compound is preferably an infrared absorbing dye, also referred to as infrared dye or IR dye. Particularly preferred infrared dyes are cyanine IR dyes.

A particularly preferred infrared dye is 5-[2,5-bis[2-[1-(1-methylbutyl)-benz[cd]indol-2(1H)-ylidene]ethylidene] cyclopentylidene]-1-butyl-3-(2-methoxy-1-methylethyl)-2,4,6(1H,3H,5H)-pyrimidinetrione (CASRN 223717-84-8) represented by the Formula IR-1:

IR-1

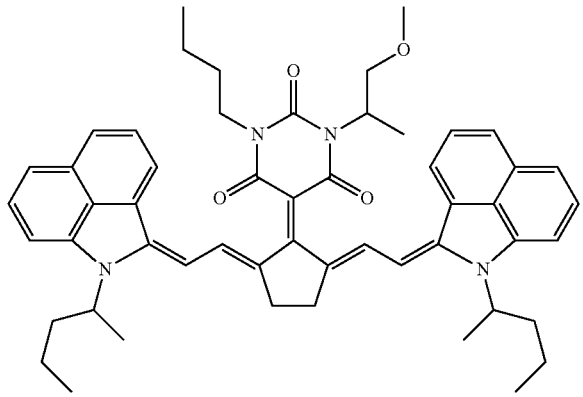

The infrared dye IR-1 has an absorption maximum $\lambda_{max}$ of 1052 nm making it very suitable for a Nd-YAG laser having an emission wavelength of 1064 nm.

The infrared red dye is preferably present in the colour forming layer in an amount of 0.01 to 1.0 g/m$^2$, more preferably in an amount of 0.02 to 0.5 g/m$^2$.

Thermal Acid Generating Compounds

The fragmentation of a leuco dye in the colour forming layer of the method of colour laser marking an article according to the present invention may be catalyzed or amplified by acids and acid generating agents.

Suitable thermal acid generating agents may be the polymeric acid generating agents based the ethylenically unsaturated polymerizable compounds A-(1) to A-(52) disclosed by U.S. Pat. No. 6,100,009 (FUJI) and herein incorporated as a specific reference.

Suitable non-polymeric acid generating agents are the compounds A-(1) to A-(52) disclosed by U.S. Pat. No. 6,100,009 (FUJI) lacking the ethylenically unsaturated polymerizable group.

The thermal acid generating agent is preferably present in the amount of 10 to 20 wt %, more preferably 14 to 16 wt % based on the total dry weight of the colour forming layer.

Preferred thermal acid generating compounds have a structure according to Formulae I or II, Formula I

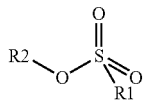

Formula II

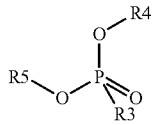

wherein

R1 and R3 independently represent an optionally substituted alkyl group, an optionally substituted (hetero)cyclic alkyl group, an optionally substituted (hetero)aryl group, an optionally substituted aralkyl group, an optionally substituted alkoxy group, an optionally substituted (hetero) cyclic alkoxy group, or an optionally substituted (hetero) aryl group.

R2, R4 and R5 independently represent an optionally substituted alkyl, an optionally substituted (hetero)cyclic alkyl group or an optionally substituted aralkyl group;R1 and R2, R4 and R5, R3 and R4, and R3 and R5 may represent the necessary atoms to form a ring.

A particular preferred thermal acid generating compound is CASNR 953-91-3.

Polymeric Binders

The colour laser markable layer may include a polymeric binder. There is no real limitation on the type of polymeric binder for so far it allows colour formation. The polymer preferably includes thermoplastic polymers, heat-curable polymers, light-, UV- and electron beam-curable polymers, room temperature-curable polymers, etc. These polymers may be in the form of a resin, an elastomer, a polymer alloy, a rubber, etc. These polymers may be used alone or in combination, i.e. as a blend, copolymer or segmented copolymer. The blends include homogeneous and micro- or macro-phase segregated blends. Also the copolymers could be homogenous copolymers or microphase segregated segmented copolymers.

Examples of the thermoplastic resins may include styrene-based resins such as polystyrene, styrene/acrylonitrile copolymers, styrene/maleic anhydride copolymers, (meth) acrylic ester/styrene copolymers and ABS resins; rubber-reinforced thermoplastic resins; olefin-based resins such as polyethylene, polypropylene, ionomers, ethylene/vinyl acetate copolymers, ethylene/vinyl alcohol copolymers, ethylene/vinyl alcohol copolymer derivatives, cyclic olefin copolymers and chlorinated polyethylenes; vinyl chloride-based resins such as polyvinyl chloride, vinylacetate/vinyl chloride copolymers, ethylene/vinyl chloride copolymers and polyvinylidene chloride; acrylic resins such as (co) polymers produced by using one or more (meth)acrylic esters such as polymethyl methacrylate (PMMA); polyacrylamides or polymethacrylamides, such as N-isopropyl acrylamides, polyamide (PA)-based resins such as polyamide 6, polyamide 6,6 and polyamide 6,12; polyester-based resins such as polyethylene terephthalate (PET), polybutylene terephthalate (PBT) and polyethylene naphthalate or any copolyester such as reaction products of a diol and a dicarboxylate (e.g. hexane diol-adipic acid copolymers); polyacetal (POM) resins; polycarbonate (PC) resins; polyarylate resins; polyphenylene ethers; polyphenylene sulfides; fluorine-containing such as comprising the monomers tetrafluoroethylene, chlorotrifluoro ethylene (CTFE), vinylidene fluoride (VDF) and vinylidene fluoride; liquid crystal polymers; imide-based resins such as polyimides, polyamide imides and polyether imides; ketone-based resins such as polyether ketones and polyether ether ketones; sulfone-based resins such as polysulfones and polyether sulfones; urethane-based resins; polyvinyl acetate; polyethyleneoxide; polyvinyl alcohol; polyvinyl alcohol derivatives; vinyl alcohol copolymers, polyvinyl ethers and copolymers; polyvinylesters and copolymers; polyvinyl acetal resins such as polyvinyl butyral; phenoxy resins; photosensitive resins; biodegradable plastics; polyethylene oxides, polypropylene oxide, polyimines, polyamines, polysaccharides and polysaccharide derivatives, etc. Among these thermoplastic resins, preferred are acrylic resins, polyacetal (POM) resins and vinyl chloride copolymers resins.

Examples of the thermoplastic elastomer may include olefin-based elastomers; diene-based elastomers; styrene-based elastomers such as styrene/butadiene/styrene block copolymers; polyester-based elastomers; urethane-based elastomers; vinyl chloride-based elastomers; polyamide-based elastomers; fluororubber-based elastomers; etc.

Examples of the polymer alloy may include PA/rubber-reinforced thermoplastic resins, PC/rubber-reinforced thermoplastic resins, PBT/rubber-reinforced thermoplastic resins, PC/PMMA, etc.

Examples of the rubber may include natural rubber, isoprene rubber, butadiene rubber, styrene/butadiene rubber, acrylonitrile/butadiene rubber, chloroprene rubber, butyl rubber, ethylene/propylene rubber, acrylic rubber, urethane rubber, chlorinated polyethylene, silicone rubber, epichlorohydrin rubber, fluororubber, polysulfide rubber, etc.

Examples of the curable polymers such as heat-curable, photocurable or room temperature-curable polymers, etc., may include acrylic resins (including acrylic polymers containing an epoxy group), epoxy resins, phenol-based resins, unsaturated polyester-based resins, alkyd resins, melamine resins, urethane-based resins, including 1K or 2K PU systems, urea resins, silicone resins, polyimide resins, bismaleimide/triazine resins, furan resins, xylene resins, guanamine resins, urea formaldehyde resins, cyanate esters or polycyanurates, dicyclopentadiene resins, etc. These resins may contain a curing agent, etc., or may comprise a self-crosslinkable polymer solely.

Besides these typical thermoset polymer systems other crosslinkable systems can be used formed by reaction of reactive polymers or reaction of functional polymers with a crosslinker.

The colour forming layer preferably includes a polymeric binder comprising vinyl acetate and at least 85 wt % of vinyl chloride based on the total weight of the binder.

In one preferred embodiment, the colour laser markable laminate according to the present invention contains an outer layer including a polymeric binder comprising vinyl acetate and at least 50 wt % of vinyl chloride based on the total weight of the binder. An advantage of the outer layer is that it is suitable as a receiver layer for dyes applied by thermal dye sublimation or even inkjet printing.

The polymeric binder in the colour forming layer and/or the outer layer is preferably a copolymer including at least 50 wt % of a vinyl chloride and 1 wt % to 50 wt % of vinyl acetate, preferably a copolymer including at least 85 wt % of a vinyl chloride and 1 wt % to 15 wt % of vinyl acetate, more preferably a copolymer including at least 90 wt % of a vinyl chloride and 1 wt % to 10 wt % of vinyl acetate with all wt % based on the total weight of the binder.

In a preferred embodiment, the polymeric binder includes at least 4 wt % of vinyl acetate based on the total weight of the binder. The advantage of having at least 4 wt % of vinyl acetate in the polymeric binder is that the solubility of the polymeric binder is drastically improved in preferred coating solvents, such as methyl ethyl ketone.

In a more preferred embodiment, the polymeric binder consists of vinyl chloride and vinyl acetate.

The polymeric binder is preferably present in the colour forming layer in an amount of 1 to 30 g/m$^2$, more preferably in an amount of 2 to 20 g/m$^2$, most preferably in an amount of 3 to 10 g/m$^2$.

Transparent Polymeric Supports

The colour laser markable laminate preferably includes a support, more preferably a transparent polymeric support, more preferably a transparent axially stretched polyester support. The colour forming layer is coated directly on the polymeric support or on a subbing layer present on the polymeric support for improving adhesion of the colour forming layer, thereby preventing falsification through delamination.

Suitable transparent polymeric supports include cellulose acetate propionate or cellulose acetate butyrate, polyesters such as polyethylene terephthalate and polyethylene naphthalate, polyamides, polycarbonates, polyimides, polyolefins, polyvinylchlorides, polyvinylacetals, polyethers and polysulphonamides.

In the most preferred embodiment, the transparent polymeric support is a biaxially stretched polyethylene terephthalate foil (PET-C foil) to be very durable and resistant to scratches and chemical substances.

The support preferably is a single component extrudate, but may also be co-extrudate. Examples of suitable co-extrudates are PET/PETG and PET/PC.

Polyester supports and especially polyethylene terephthalate supports are preferred because of their excellent properties of dimensional stability. When polyester is used as the support material, a subbing layer is preferably employed to improve the bonding of layers, foils and/or laminates to the support.

The manufacturing of PET-C foils and supports is well-known in the art of preparing suitable supports for silver halide photographic films. For example, GB 811066 (ICI) teaches a process to produce biaxially oriented polyethylene terephthalate foils and supports.

The polyethylene terephthalate is preferably biaxially stretched with a stretching factor of at least 2.0, more preferably at least 3.0 and most preferably a stretching factor of about 3.5. The temperature used during stretching is preferably about 160° C.

Methods to obtain opaque polyethylene terephthalate and biaxially oriented films thereof of have been disclosed in, e.g. US 2008238086 (AGFA).

White Opaque Core Supports

The colour laser markable document according to the present invention may include a core support. The core support is preferably an opaque white core support. The advantage of an opaque white core support is that any information present on the document is more easily readable and that a colour image is more appealing by having a white background.

Preferred opaque white core supports include resin coated paper supports, such as polyethylene coated paper and polypropylene coated paper, and synthetic paper supports such as Synaps™ synthetic paper of Agfa-Gevaert NV.

Other examples of useful high-quality polymeric supports for the present invention include opaque white polyesters and extrusion blends of polyethylene terephthalate and polypropylene. Also Teslin™ may be used as support.

Instead of a white support, a white opacifying layer can be coated onto a transparent polymeric support, such as those disclosed above. The opacifying layer preferably contains a white pigment with a refractive index greater than 1.60, preferably greater than 2.00, and most preferably greater than 2.60. The white pigments may be employed singly or in combination. Suitable white pigments include C.I. Pigment White 1, 3, 4, 5, 6, 7, 10, 11, 12, 14, 17, 18, 19, 21, 24, 25, 27, 28 and 32. Preferably titanium dioxide is used as pigment with a refractive index greater than 1.60. Titanium oxide occurs in the crystalline forms of anatase type, rutile type and brookite type. In the present invention the rutile type is preferred because it has a very high refractive index, exhibiting a high covering power.

Subbing Layers

The polymeric support may be provided with one or more subbing layers. This has the advantage that the adhesion between the colour forming layer and the polymeric support is improved.

Useful subbing layers for this purpose are well known in the photographic art and include, for example, polymers of vinylidene chloride such as vinylidene chloride/acrylonitrile/acrylic acid terpolymers or vinylidene chloride/methyl acrylate/itaconic acid terpolymers.

The application of subbing layers is well-known in the art of manufacturing polyester supports for silver halide photographic films. For example, the preparation of such subbing layers is disclosed in U.S. Pat. No. 3,649,336 (AGFA) and GB1441591 (AGFA);

Suitable vinylidene chloride copolymers include: the copolymer of vinylidene chloride, N-tert.-butylacrylamide, n-butyl acrylate, and N-vinyl pyrrolidone (e.g.70:23:3:4), the copolymer of vinylidene chloride, N-tert.-butylacrylamide, n-butyl acrylate, and itaconic acid (e.g. 70:21:5:2), the copolymer of vinylidene chloride, N-tert.-butylacrylamide, and itaconic acid (e.g. 88:10:2), the copolymer of vinylidene chloride, n-butylmaleimide, and itaconic acid (e.g. 90:8:2), the copolymer of vinyl chloride, vinylidene chloride, and methacrylic acid (e.g. 65:30:5), the copolymer of vinylidene chloride, vinyl chloride, and itaconic acid (e.g. 70:26:4), the copolymer of vinyl chloride, n-butyl acrylate, and itaconic acid (e.g. 66:30:4), the copolymer of vinylidene chloride, n-butyl acrylate, and itaconic acid (e.g. 80:18:2), the copolymer of vinylidene chloride, methyl acrylate, and itaconic acid (e.g.90:8:2), the copolymer of vinyl chloride, vinylidene chloride, N-tert.-butylacrylamide, and itaconic acid (e.g. 50:30:18:2). All the ratios given between brackets in the above-mentioned copolymers are ratios by weight.

In a preferred embodiment, the subbing layer has a dry thickness of no more than 2 μm or preferably no more than 200 mg/m$^2$.

Coating Solvents

For coating the colour forming layer and the outer layer, one or more organic solvents may be used. The use of an organic solvent facilitates the dissolution of the polymeric binder and specific ingredients such as the infrared dye.

A preferred organic solvent is methylethylketone (MEK) because it combines a high solubilizing power for a wide range of ingredients and it provides, on coating the colour forming layer, a good compromise between the fast drying of the layer(s) and the danger of fire or explosion thereby allowing high coating speeds.

Laser Marking Methods

The method for preparing a colour laser marked document according to the present invention comprises the steps of:

a) laminating a colour laser markable laminate according to the present invention onto a core support; and
b) laser marking the colour forming layer by an infrared laser.

In a preferred embodiment of the method, the core support is an opaque white core support. In a particular preferred embodiment of the method, the opaque white core support is a PETG support.

In a preferred embodiment of the method, the colour laser marked document is a security document.

In a preferred embodiment of the colour laser marking method, the document is laser marked through a transparent biaxially stretched polyethylene terephthalate foil (PET-C). This PET-C foil is preferably used as support for the colour forming layer.

PET-C foils, such as PETix™ from Agfa-Gevaert NV, are very durable and resistant to mechanical influences (flexion, torsion, scratches), chemical substances, moisture and temperature ranges. This is especially useful for security documents such as identification cards and credit cards for which the average daily usage has augmented substantially from less than 1 time per week to 4 times per day. The card body has to withstand not only this increased usage, but also the associated storage conditions. Cards are no longer safely tucked away in cabinets at home or seldom-opened wallets, but are now loosely put away in pockets, purses, sport bags etc.—ready for immediate use.

PVC (polyvinylchloride) is the most widely used material for plastic cards but has low durability of the card body, resulting in an effective lifetime of only 1-3 years, much lower than the lifetime of the often expensive chips included in the card. Other materials like Teslin™ and ABS are only suitable for very low-end or single-use cards. PC (polycarbonate) can be used for longer-life and more secure ID cards, but has a high production cost and a low resistance to torsion, scratching and chemicals.

Other Security Features

The colour laser markable laminate is preferably combined with one or more other security features to increase the difficulty for falsifying the document.

To prevent forgeries of identification documents, different means of securing are used. One solution consists in superimposing lines or guilloches on an identification picture such as a photograph. In that way, if any material is printed subsequently, the guilloches appear in white on added black background. Other solutions consist in adding security elements such as information printed with ink that reacts to ultraviolet radiation, micro-letters concealed in an image or text etc.

Suitable other security features such as anti-copy patterns, guilloches, endless text, miniprint, microprint, nanoprint, rainbow colouring, 1D-barcode, 2D-barcode, coloured fibres, fluorescent fibres and planchettes, fluorescent pigments, OVD and DOVID (such as holograms, 2D and 3D holograms, kinegrams™, overprint, relief embossing, perforations, metallic pigments, magnetic material, Metamora colours, microchips, RFID chips, images made with OVI (Optically Variable Ink) such as iridescent and photochromic ink, images made with thermochromic ink, phosphorescent pigments and dyes, watermarks including duotone and multitone watermarks, ghost images and security threads.

EXAMPLES

Materials

All materials used in the following examples were readily available from standard sources such as ALDRICH CHEMICAL Co. (Belgium) and ACROS (Belgium) unless otherwise specified. The water used was deionized water.

UV1, a triarylimidazole UV absorber commercially available as Tinuvin 477 from BASF.

UV2, a triarylimidazole UV absorber commercially available as Tinuvin 460 from BASF.

UV3, a triarylimidazole UV absorber commercially available as Tinuvin 1600 from BASF.

UV4, a hydrophenylbenzotriazole UV absorber commercially available as Tinuvin 326 from BASF.

UV5, a hydrophenylbenzotriazole UV absorber commercially available as Tinuvin 234 from BASF.

HALS1, a HALS compound commercially available as Tinuvin 770 from BASF.

HALS2, a HALS compound commercially available as Tinuvin 292 from BASF.

HALS3, a HALS compound commercially available as Tinuvin 123 from BASF.

AS1, tridodecylamine commercially available from Sigma-Aldrich.

AO1, a phenolic antioxidant commercially available as Irganox 1035 from BASF.

AO2, butylated hydroxytoluene, a phenolic antioxidant commercially available from Sigma-Aldrich.

AO3, a phosphite antioxidant commercially available as BEB36 from Adeka Palmarole.

AO4, 6-O-palmitoyl-L-ascorbic acid, a Vitamin C derivative commercially available from Sigma-Aldrich.

CORE is a 500 μm opaque PETG core available as PET-G 500 type 9311 from WOLFEN.

Resorcinol from Sumitomo Chemicals. CCE is Bayhydrol H 2558, an anionic polyester urethane (37.3%) from BAYER.

Par is a dimethyltrimethylolamine formaldehyde resin from Cytec industries.

PAR-sol is a 40 wt % aqueous solution of Par.

PEA is Tospearl™ 120 from Momentive Performance materials.

PEA-sol is a 10 wt % (50/50) aqueous/ethanol dispersion of PEA.

Dowfax™2A1 from Pilot Chemicals C is a Alkyldiphenyloxide disulfonate (4.5% wt %).

DOW-sol is a 2.5 wt % solution of Dowfax™ 2A1 in isopropanol.

Surfynol™ 420 from Air Products is a non ionic surfactant.

Surfynsol is a 2.5 wt % solution of Surfynol™ 420 in isopropanol.

Solvin™ 557RB, a vinylchloride-vinylacetate copolymer with 11% vinyl acetate, provided by SOLVAY.

Sunvac HH, a vinylchloride-vinylacetate copolymer with 14% vinyl acetate, provided by SUNYCHEM.

IR1 is an IR dye with the following formula and prepared as disclosed in EP-A 2463109 (Agfa), paragraphs [0150] to [0159].

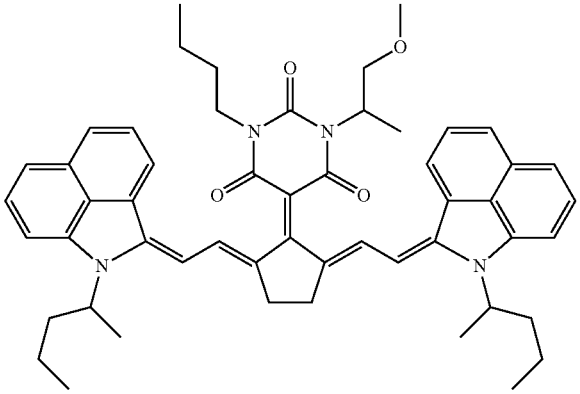

LD1, the leuco dye Pergascript Black 2C, commercially available from BASF.

Measurement Methods

1. Optical Density

The optical density (OD) was measured in reflection using a spectrodensitometer Type GretagMacbeth SPM50 using a visual filter.

2. Suntest

The light stability was evaluated by measuring the OD of the security documents after exposing them to a suntest using an Atlas(TM) Suntest with a xenon-lamp for 8 hours at 765 W/m$^2$.

3. Laser Marking

The security documents were laser marked using a Rofin RSM Powerline E laser (10 W) with settings 33 ampere and 33 kHz at 100% power.

Preparation of PET-C Foil

A coating composition SUB was prepared by mixing the components according to Table 2 using a dissolver.

A 1100 μm thick polyethylene terephthalate sheet was first longitudinally stretched and then coated on both sides with the coating composition SUB (the wet coating thickness was10 μm). After drying, the longitudinally stretched and coated polyethylene terephthalate sheet was transversally stretched to produce a single side subbed 63 μm thick sheet PET-C, which was transparent and glossy.

TABLE 2

| Components of SUB | wt % |
|---|---|
| deionizedwater | 76.66 |
| CCE | 18.45 |
| Resorcinol | 0.98 |
| PAR-sol | 0.57 |
| PEA-sol | 0.68 |
| DOW-sol | 1.33 |
| Surfynsol | 1.33 |

Preparation of Colour Laser Markable Laminates LML-01 to LML-12

The colour laser markable laminates LML-01 to LML-12 were obtained by coating the components as defined in Table 3 dissolved in MEK (coating CT1) onto the PET-C foil described above. The coating solutions were applied at a wet coating thickness of 90 μm and dried at 50° C. for 5 minutes in a circulation oven.

TABLE 3

| Components CT1 | | g/m$^2$ |
|---|---|---|
| Polymeric Binder | Solvin ™ 557RB | 7.100 g |
| IR dye | IR1 | 0.029 |
| Leuco dye | LD1 | 1.53 |
| Daylight Stability Additive | See Table 4 | See Table 4 |

TABLE 4

| | Daylight Stability Additive | g/m$^2$ |
|---|---|---|
| LML-01 | — | — |
| LML-02 | HALS1 (pKb < 7.0) | 0.050 |
| LML-03 | HALS2 (pKb < 7.0) | 0.053 |
| LML-04 | HALS3 (pKb > 7.0) | 0.077 |
| LML-05 | AS1 (pKb < 7.0) | 0.055 |
| LML-06 | AO1 | 0.068 |
| LML-07 | AO2 | 0.023 |
| LML-08 | AO3 | 0.066 |
| LML-09 | AO4 | 0.044 |
| LML-10 | HALS1 + UV1 | 0.050 + 1.80 |
| LML-11 | AS1 + UV1 | 0.055 + 1.80 |
| LML-12 | HALS1 | 0.035 |

In all laminates LML prepared, an equimolar amount of Daylight Stability Additives were used, except for LML-12 wherein less Daylight Stability Additive (±70%) is used.

Preparation of the Outer Laminates OL-01 to OL-10

The Outer Laminates OL-01 to OL-10 were produced by coating the components as defined in Table 5 dissolved in MEK (coating CT2) onto the subbed side of the above described PET-C. The coating solutions were applied at a wet coating thickness of 50 μm and then dried at 60° C. for 6 minutes in a circulation oven.

TABLE 5

| Components CT2 | | g/m$^2$ |
|---|---|---|
| Polymer binder | Sunvac HH | 6.35 |
| Daylight stability additive | See Table6 | See Table 6 |

TABLE 6

| | Daylight Stability Additive | (g/m$^2$) |
|---|---|---|
| OL-01 | UV1 | 1.80 |
| OL-02 | UV2 | 1.18 |
| OL-03 | UV3 | 1.14 |
| OL-04 | UV4 | 0.59 |
| OL-05 | UV5 | 0.84 |
| OL-06 | UV2 | 0.83 |
| OL-07 | UV2 | 0.35 |
| OL-08 | UV1 + HALS1 | 1.80 + 0.05 |

In all laminates OL prepared, an equimolar amount of Daylight Stability Additives were used, except for OL-06 and OL-07 wherein less Daylight stability additives are used (respectively ±70% and ±30%).

The UV absorption properties of the UV absorbers are given in Table 7.

TABLE 7

| Compound | highest absorption between 300 and 400 above 350 nm |
|---|---|
| UV1 | yes |
| UV2 | yes |
| UV3 | no |
| UV4 | yes |
| UV5 | no |

Preparation of the Colour Laser Markable Articles LMA-01 to LMA-23

An assembly was made of, in order, the white opaque core support CORE; the Colour Laser Markable Laminates LML-01 to LML-12 wherein the coating CT1 of the colour laser markable laminates LML-01 to LML-12 faces the white opaque core support CORE; and the Outer Laminates OL-01 to OL-08 wherein the coating CT2 of the Outer Laminates OL-01 to OL-08 faces the white opaque core support CORE.

The assembly was then laminated into the colour laser markable article LMA-01 to LMA-23 using a Photonex-325 LSI laminator at a temperature of 130° C. and speed mode 1.

The following Colour Laser Markable Articles were prepared (Table 8).

TABLE 8

| Laser Markable Article | Laser Markable Laminate | Outer Laminate |
|---|---|---|
| LMA-01 (COMP) | LML-01 | — |
| LMA-02 (COMP) | LML-01 | OL-01 |
| LMA-03 (COMP) | LML-01 | OL-02 |
| LMA-04 (COMP) | LML-01 | OL-08 |
| LMA-05 (INV) | LML-02 | OL-01 |
| LMA-06 (INV) | LML-02 | OL-02 |
| LMA-07 (INV) | LML-02 | OL-03 |
| LMA-08 (INV) | LML-02 | OL-04 |
| LMA-09 (INV) | LML-02 | OL-05 |
| LMA-10 (INV) | LML-03 | OL-01 |
| LMA-11 (INV) | LML-04 | OL-01 |
| LMA-12 (INV) | LML-05 | OL-01 |
| LMA-13 (COMP) | LML-06 | OL-01 |
| LMA-14 (COMP) | LML-07 | OL-01 |
| LMA-15 (COMP) | LML-08 | OL-01 |
| LMA-16 (COMP) | LML-09 | OL-01 |
| LMA-17 (COMP) | LML-02 | — |
| LMA-18 (COMP) | LML-03 | — |
| LMA-19 (COMP) | LML-10 | — |
| LMA-20 (COMP) | LML-11 | — |
| LMA-21 (INV) | LML-12 | OL-02 |
| LMA-22 (INV) | LML-02 | OL-06 |
| LMA-23 (INV) | LML-02 | OL-07 |

Evaluation and Results:

After lamination, the optical density of the Colour Laser Markable Articles were measured ($OD_{MIN}$). Then, a test image of 7 ×9 $mm^2$ was laser marked and the optical density was measured within the laser-marked area ($OD_{LM}$). Successively, the Colour Laser Markable Articles were placed in a suntest. The optical density was measured after suntest in the non Laser-marked areas ($OD_{SUN}$). $OD_{MIN}$, $OD_{LM}$ and $OD_{SUN}$ are listed in Table 9.

TABLE 9

| | $OD_{MIN}$ | $OD_{LM}$ | $OD_{SUN}$ |
|---|---|---|---|
| LMA-01 (COMP) | 0.20 | 1.49 | 1.97 |
| LMA-02 (COMP) | 0.20 | 1.16 | 1.14 |
| LMA-03 (COMP) | 0.20 | 1.33 | 1.11 |
| LMA-04 (COMP) | 0.29 | 1.69 | 1.19 |
| LMA-05 (INV) | 0.22 | 2.47 | 0.23 |
| LMA-06 (INV) | 0.21 | 2.52 | 0.41 |
| LMA-07 (INV) | 0.34 | 2.48 | 0.65 |
| LMA-08 (INV) | 0.22 | 2.47 | 0.34 |
| LMA-09 (INV) | 0.21 | 2.44 | 0.72 |
| LMA-10 (INV) | 0.29 | 2.56 | 0.28 |
| LMA-11 (INV) | 0.30 | 1.78 | 0.68 |
| LMA-12 (INV) | 0.28 | 2.35 | 0.32 |
| LMA-13 (COMP) | 0.23 | 2.53 | 1.11 |
| LMA-14 (COMP) | 0.24 | 1.26 | 1.52 |
| LMA-15 (COMP) | 0.28 | 2.32 | 1.19 |
| LMA-16 (COMP) | 0.45 | 2.32 | 1.06 |
| LMA-17 (COMP) | 0.23 | 2.25 | 2.21 |
| LMA-18 (COMP) | 0.22 | 2.37 | 2.39 |
| LMA-19 (COMP) | 0.39 | 2.13 | 0.80 |
| LMA-20 (COMP) | 0.40 | 1.91 | 0.70 |
| LMA-21 (INV) | 0.18 | 1.30 | 0.47 |
| LMA-22 (INV) | 0.18 | 1.26 | 0.30 |
| LMA-23 (INV) | 0.19 | 1.17 | 0.76 |

An Optical Density of the Colour Laser Markable Articles ($OD_{MIN}$) of 0.35 or less ensures bright coloured images. A sufficient daylight stability of the Colour Laser Markable Articles was observed when the optical density measured after the suntest in the non Laser-marked areas ($OD_{SUN}$) was 1.00 or less, preferably 0.5 or less.

It is clear from the results of Table 9 that:

A very high $OD_{SUN}$ was observed for the LMA having no base in the colour forming layer and no UV absorber in the outer layer (LMA-01).

A too high $OD_{SUN}$ was observed for those LMA having only an UV absorber in the outer layer (LMA-02 and LMA-03).

A too high $OD_{SUN}$ was observed for those LMA having both an UV absorber and a base compound in the outer layer (LMA-04).

A too high $OD_{SUN}$ was observed for those LMA having an UV absorber in the outer layer and an antioxidant in the colour forming layer (LMA-13 to LMA-16).

A very high $OD_{SUN}$ was observed when a base was present in the colour forming layer but in the absence of an UV absorber in the outer layer (LMA-17 and LMA-18).

A too high $OD_{MIN}$ was observed when both a base and an UV absorber was present in the colour forming layer (LMA-19 and LMA-20).

A low enough $OD_{MIN}$ and $OD_{SUN}$ are only observed for the inventive examples wherein an UV absorber is present in the outer layer and a base in the colour forming layer.

The best results are obtained with an UV absorber in the outer layer having in the region between 300 and 400 nm a maximal absorption above 350 nm and a base with a pKb below 7.

The invention claimed is:

1. A color laser markable laminate comprising:

a color laser markable layer including a leuco dye, an infrared absorbing compound, and an acid scavenger;

an optional adhesive layer;

a support;

an optional outerlayer; wherein the support, the optional adhesive layer, or the optional outer layer includes a UV absorbing compound; and the acid scavenger includes an organic base that has a pKb of less than 7.

2. The color laser markable laminate according to claim 1, wherein the UV absorbing compound has, within a wavelength region between 300 nm and 400 nm, a maximal absorption above 350 nm.

3. The color laser markable laminate according to claim 1, wherein an amount of the UV absorbing compound is 0.1 $g/m^2$ or more.

4. The color laser markable laminate according to claim 1, wherein the organic base includes an amine.

5. The color laser markable laminate according to claim 1, further comprising an acid generating compound.

6. The color laser markable laminate according to claim 5, wherein the acid generating compound includes a sulfonate ester.

7. The color laser markable laminate according to claim 1, wherein the infrared absorbing compound includes a polymethine IR dye having an absorption maximum in a region from 800 nm to 1200 nm.

8. The color laser markable laminate according to claim 1, further comprising a polymeric binder including vinyl acetate and at least 50 wt % of vinyl chloride based on a total weight of the polymeric binder.

9. The color laser markable laminate according to claim 1, wherein the support is a transparent biaxially stretched polyester support.

10. A color laser markable document comprising:

a core support; and the color laser markable laminate according to claim 1; wherein the color laser markable layer is located between the core support and the support.

11. The color laser markable document according to claim 10, further comprising:

a second color laser markable laminate including:

a color laser markable layer including a leuco dye, an infrared absorbing compound, and an acid scavenger;

an optional adhesive layer;

a support;

an optional outerlayer; wherein the support, the optional adhesive layer, or the optional outer layer includes a UV absorbing compound; and the color laser markable layer of the second color laser markable laminate is located between the core support and the support of the second color laser markable laminate.

12. A method for preparing a color laser marked document, the method comprising the steps of:

laminating the color laser markable laminate according to claim 1 onto a core support; and laser marking the color laser markable layer using an infrared laser.

13. The method according to claim 12, wherein the color laser marked document is a security document selected from the group consisting of a passport, a personal identification card, and a product identification document.

* * * * *